US005890237A

United States Patent [19]

Herman

[11] Patent Number: 5,890,237

[45] Date of Patent: Apr. 6, 1999

[54] CUSHION PAD STRUCTURE OF SWIMMING GOGGLES

[76] Inventor: Chiang Herman, 11-2, No-634-9, Ching-ping Rd., Chung-Ho city, Taipei Hsien, Taiwan

[21] Appl. No.: 951,913

[22] Filed: Oct. 16, 1997

[51] Int. Cl.[6] ..... A61F 9/02

[52] U.S. Cl. ..... 2/440; 2/439; 2/445

[58] Field of Search ..... 2/439, 428, 440, 2/441, 429, 430, 435, 436, 437, 438, 426, 445

[56] References Cited

U.S. PATENT DOCUMENTS

| | | | |
|---|---|---|---|
| 1,720,814 | 7/1929 | Baker | 2/440 |
| 2,406,608 | 8/1946 | Joyce | 2/440 |
| 2,918,676 | 12/1959 | Matheson | 2/440 |
| 4,264,987 | 5/1981 | Runckel | 2/428 |
| 4,689,837 | 9/1987 | Bollé | 2/428 |
| 5,093,940 | 3/1992 | Nishiyama | 2/440 |
| 5,459,882 | 10/1995 | Yamaoto | 2/428 |

*Primary Examiner*—John J. Calvert
*Assistant Examiner*—Larry D. Worrell, Jr.
*Attorney, Agent, or Firm*—Pro-Techtor International Services

[57] ABSTRACT

A swimming goggle structure includes lens frames, lenses, cushion pads and a head strap. The cushion pads of the swimming goggles include a collapsible layer and a resilient layer. The collapsible layer has a cushioning portion and a connection portion. The cushioning portion is mounted to the lens frame and is collapsible. The connection portion is connected to the resilient layer. The resilient layer is made of a resilient material, such as foam materials, for example foam rubber and foam plastics, and sponge. The collapsible layer collapses upon worn on the wearer's face to create a negative pressure suction inside the goggles. The resilient layer provides a comfortable engagement with the wearer's face and also provides a water-tight, hermetic contact engagement with the wearer's face.

12 Claims, 5 Drawing Sheets

CUSHION PAD STRUCTURE OF SWIMMING GOGGLES

FIELD OF THE INVENTION

The present invention relates generally to swimming goggles and in particular to a cushion pad structure of the swimming goggles which is more comfortable and more compliant to the wearer's face.

BACKGROUND OF THE INVENTION

To provide a comfortable engagement with the wearer's face, swimming goggles are usually provided with cushion pads of resilient material mounted to the lens frames of the goggles to be in resilient contact with the wearer's face around the eye sockets. Conventionally, the swimming goggle cushion pads have two types. The first one is made of foam material and the second one comprises a suction cup like configuration. An example of the foam type cushion pad is shown in FIG. 1, comprising a foam pad 50 which is manually mounted to the lens frame 51 by means of for example adhesive. The suction cup type cushion pad is further divided into two classes, one being formed by manually fitting the cushion pad to the lens frame as shown in FIG. 2 and the other being integrally formed with the lens frame as a unitary member, see FIG. 3. Both the foam type and the suction cup type have disadvantages which will be now briefly discussed.

The foam type cushion pad is made of a foam material so that it is resilient, providing a very comfortable engagement with the wearer's face skin around the eye socket. Further, the foam material may properly dissipate heat generated by the wearer's skin. However, the foam material is poor in providing hermetic and thus water leakage proof attachment to the wearer's skin. Such a property is a basic requirement for swimming goggles and to provide such a property, upon contact with the wearer's skin when the swimming goggles are being worn, the goggles should be capable of expelling the air between the goggles and the wearer's face which, together with the compliance of the cushion pad with the wearer's face, provides the desired water tight engagement with the wearer's face. Since the foam cushion pad is in general formed as a block, it is difficult to compliantly engage with the wearer's face and almost impossible to expel air from inside the goggles so that it only creates a very poor water leakage proof attachment to the wearer's face.

On the other hand, the suction cup type cushion pad, is usually made of rubber or thermoplastic plastics so as to be capable of providing an excellent hermetic or water leakage proof property. The suction cup type cushion pad usually has a J-shaped cross section which allows the cushion pad to collapse upon contact with the wearer's face so that it is helpful in expelling air from inside the goggles. Further, the suction cup type cushion pad comprises a thin flange to be contacted by the wearer's face which may Immediately comform to the face skin around the eye socket of the wearer while expelling air out of the goggles so as to achieve an excellent hermetic or water leakage proof attachment to the wearer's face. However, the rubber or plastics cushion pad can cause an uncomfortable contact between the cushion pad and the wearer's face. Further since the suction cup type cushion pad provides a very good hermetic engagement with wearer's face skin, which may provide a persistent negative pressure inside the goggles, the negative pressure condition inside the goggles causes stress on the eye socket. Further, such a good hermetic engagement achieved by means of the negative pressure inside the goggles also makes it more difficult and uncomfortable in taking off the goggles. Thus, as compared with the foam type cushion pad, the suction cup type cushion pad is poor in providing a comfortable engagement with the wearer's face.

Thus, it is desired to provide a swimming goggle cushion pad which has the advantages of both the foam type cushion pad and the suction cup type cushion pad.

SUMMARY OF THE INVENTION

An object of the present invention is to provide a swimming goggle cushion pad, which provides an engagement with the wearer's face that is both skin comfortable and hermetic so that the swimming goggles may be worn in a very comfortable manner and water leakage may be eliminated.

Another object of the present invention is to provide a swimming goggle cushion pad which has a two phases of attachment to the wearer's face on which the first phase is the suction and the second phase is the compliance with the wearer's face so that the swimming goggles provide a comfortable engagement in wearing and causes no stress on the eye sockets upon taking it off.

Thus, to achieve the above objects, in accordance with the present invention, a cushion pad structure of swimming goggles is provided, comprising a collapsible layer and a resilient layer. The collapsible layer has a J-shaped cross section which may collapse to provide cushioning effect for immediately expelling air out of the goggles, creating air- and water-tightness with the wearer's face. A negative pressure is present inside the goggles in wearing the goggles which may cause an excellent compliant engagement with the face.

In accordance with the present invention. the collapsible layer comprises a cushioning portion and a connection portion. The cushioning portion is connected to the lens frame and is compressible or collapsible. The connection portion is for connection by the resilient layer. The resilient layer may be of for example foam material or sponge with a sheet of cloth-like material attached thereto.

The objects, advantages and features of the present invention will be apparent from the following description of preferred embodiments thereof, with reference to the attached drawings, wherein:

DETAILED DESCRIPTION OF THE PREFERRED EMBODIMENTS

Figure 1:
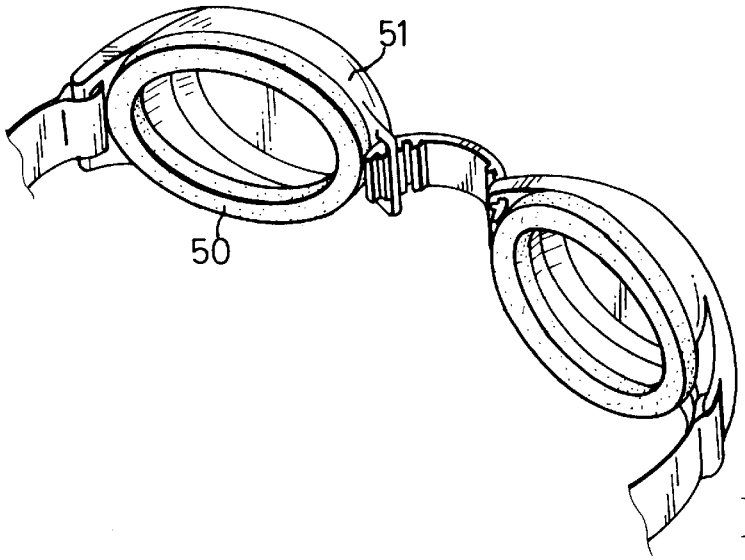
FIG. 1 is an exploded perspective view showing a pair of conventional swimming goggles of which the cushion pads are made of foam material.
Figure 2:
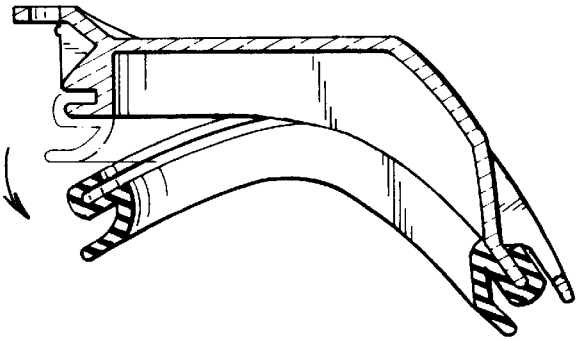
FIGS. 2 and 3 are cross-sectional views of other conventional swimming goggles.
Figure 3:
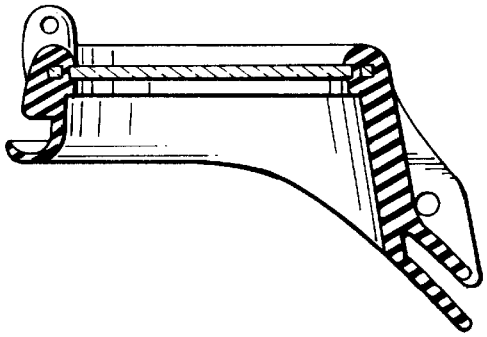
Figure 4:
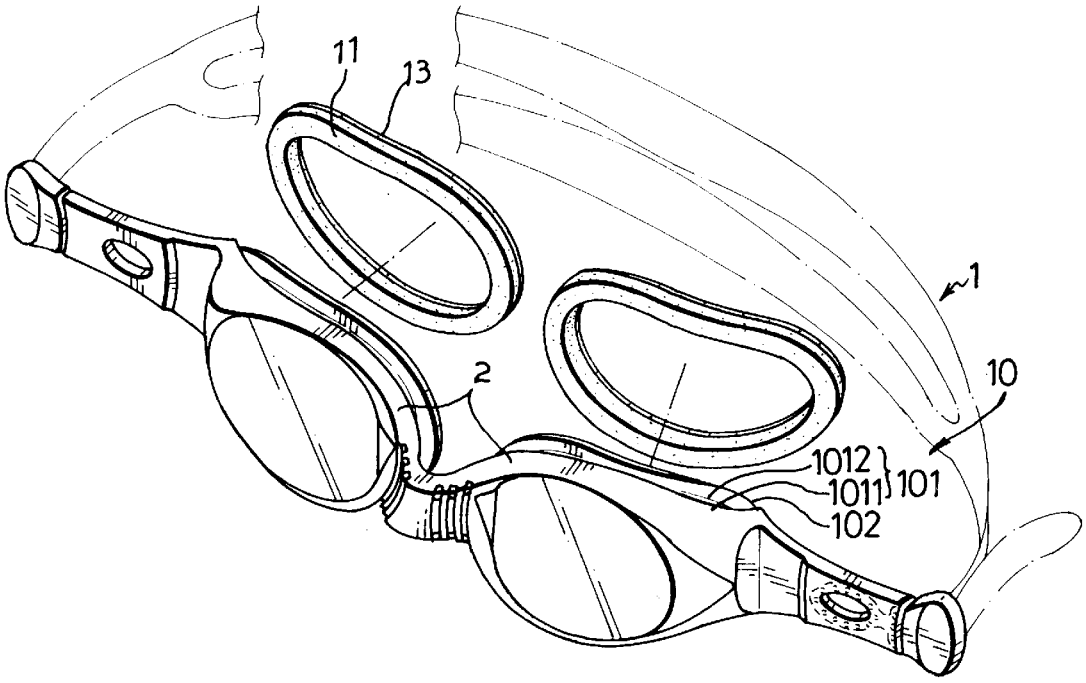
FIG. 4 is an exploded perspective view showing a cushion pad of a pair of swimming goggles in accordance with the present invention integrally formed with lens frames of the swimming goggles.

Referring to the drawings and in particular to FIG. 4. wherein a pair of swimming goggles incorporating cushion pads constructed in accordance with the present invention is shown, the goggles generally comprise two lenses respectively received within lens receiving slot formed along an inner circumference of each of two lens frames. The lens frames are connected by means of a nose bridge which may be integrally formed with an inner side of the lens frames or may be separated from the lens frame and connected thereto. A strap may be provided to connect between outer sides of the frames.

The cushion pads in accordance with the present invention that are designated with reference numeral 1 are integral with the lens frames 2 of the pair of swimming goggles, each corresponding to one of the two lenses of the goggles. Each of the cushion pads 1 comprises a collapsible layer 10 and a resilient layer 11. The collapsible layer 10 comprises a cushioning portion 101 and a connection portion 102. The cushioning portion 1O1 has a J-sectioned configuration, having an overall length between 2–5 mm and preferably 3.5 mm. The J-sectioned cushioning portion 101 comprises a straight section 1011 having an end connected to and preferably integral with an inner side of the respective frame 2 and a bent section 1012 extending from the straight section 1011 in a diverging manner at a suitable angle. The connection portion 102 extends from the bent section 1012 of the cushioning portion 101 to define a circumferential flange having a surface substantially parallel with the lens to which the resilient layer 11 is fixed.

The straight section 1011 of the J-sectioned cushioning portion 101 of the collapsible layer 10 may have a thickness ranging between 0.7–2 mm. The connection portion 11 may also have a similar thickness.

The resilient layer 11 is made of a suitable resilient material, such as foam material, for example foam rubber, and sponge. In accordance with a preferred embodiment of the present invention, the resilient layer 11 comprises foam material made in the form of a ring defining a face contact surface for contact engagement with a wearer's face with a piece of cloth material 13 attached thereon. The cloth material 13 is to provide a more comfortable engagement with the wearer's face skin, especially the cloth material 13 is provided to at least partially absorb sweat on the skin so as to prevent irritation and discomfort caused by the sweat between the face skin and the cushion pads that are in tight contact with the face skin. The resilient layer 11 is fixed to the connection portion 102 by means of for example adhesive for provision of a comfortable and soft engagement with the face skin around the eye socket. In accordance with a preferred embodiment of the present invention, the resilient layer 11 has an overall thickness ranging between 2–5 mm and preferably 2.5 mm.

Figure 5:
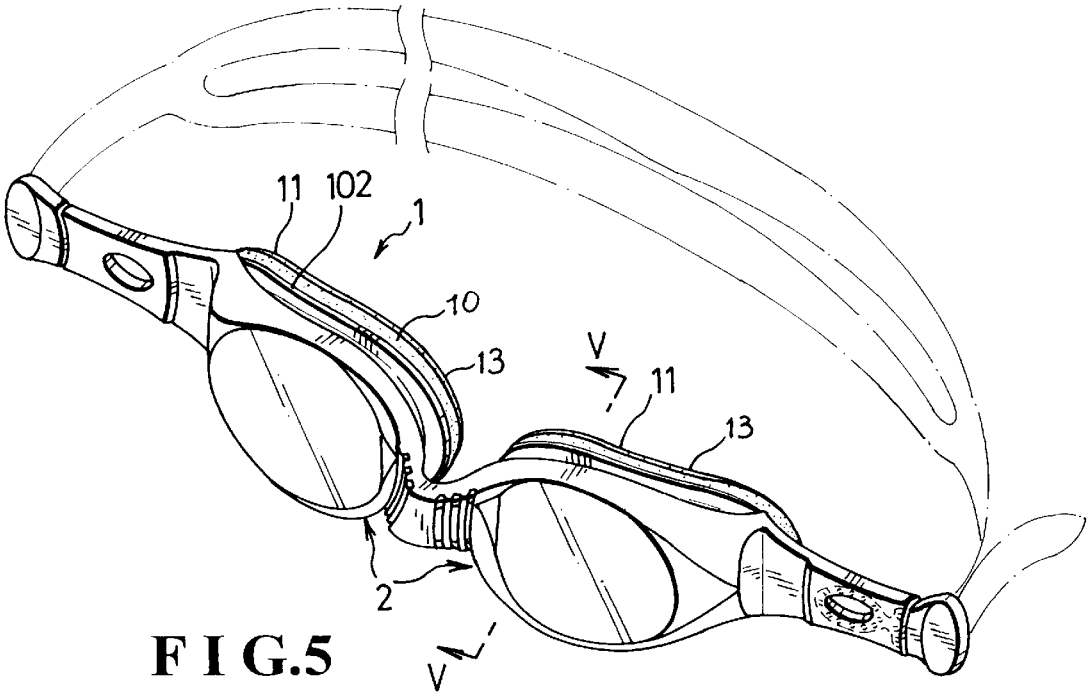
FIG. 5 is a perspective view of the swimming goggles with the cushion pad mounted thereon.
Figure 6A:
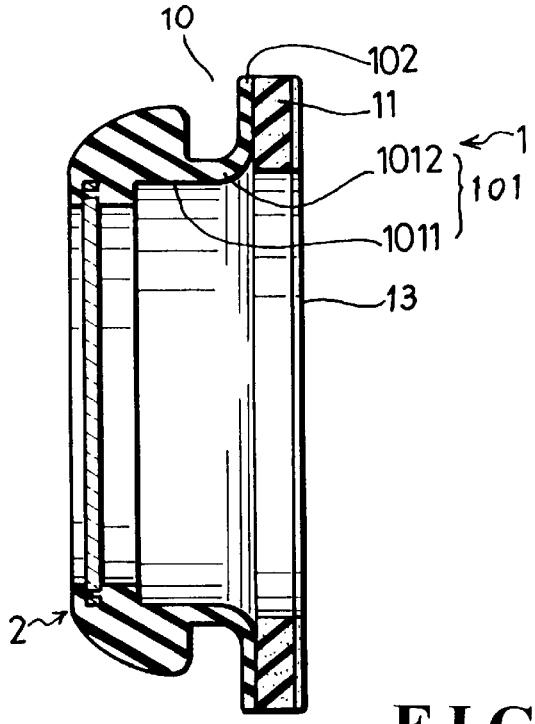
FIG. 6A is a cross-sectional view taken along line V—V of FIG. 5.
Figure 6B:
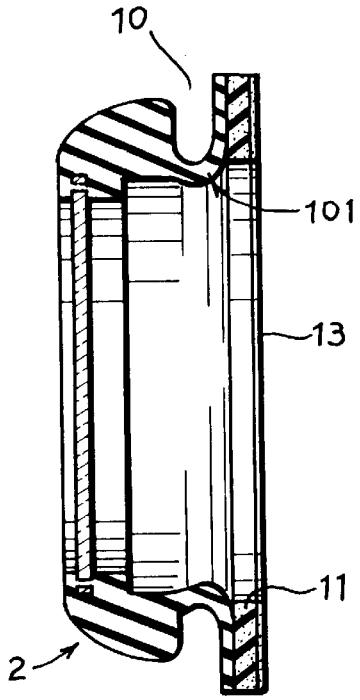
FIGS. 6B and 6C are a cross-sectional view and a top view showing the suction operation provided by the collapsible layer of the cushion pad in accordance with the present invention.
Figure 6C:
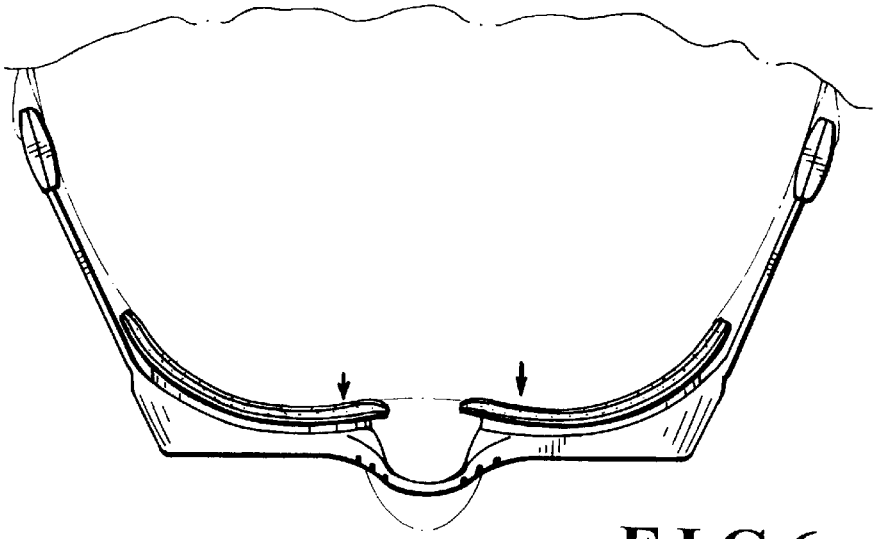

With reference to FIG. 5, which shows that the cushion pads 1 of the present invention, when mounted to the goggle frame 2, have an overall length substantially corresponding to that of the conventional foam type cushion pad or suction cup type cushion pad, the collapsible layer 10 and the resilient layer 11 of the cushion pads 1 of the present invention each provide different function. Referring to FIG. 6A, the collapsible layer 10 provides a suitable collapse by means of J-sectioned cushioning portion 101 when worn to force the air inside the goggles to be expelled so as to create a negative pressure suction inside the lens frame 2. Referring to FIGS. 6B and 6C, the collapsible layer 10 may provide an air- and water-tightness hermetic engagement with the face skin by means of the connection portion 102 complying with the wearer's skull upon the collapse of the cushioning portion 101 of the cushion pad 1 and the expulsion of air out of the goggles caused by the collapse. The resilient layer 11 and the cloth material 13 attached thereon are to provide a comfortable engagement with the wearer's face by means of the resiliency thereof Thus, the swimming goggles incorporating the cushion pad structure in accordance with the present invention not only provide a comfortable engagement with the wear's face similar to the conventional foam type cushion pad, but is also effective in preventing water penetration into the goggles as is the conventional suction cup type cushion pad.

Figure 7:
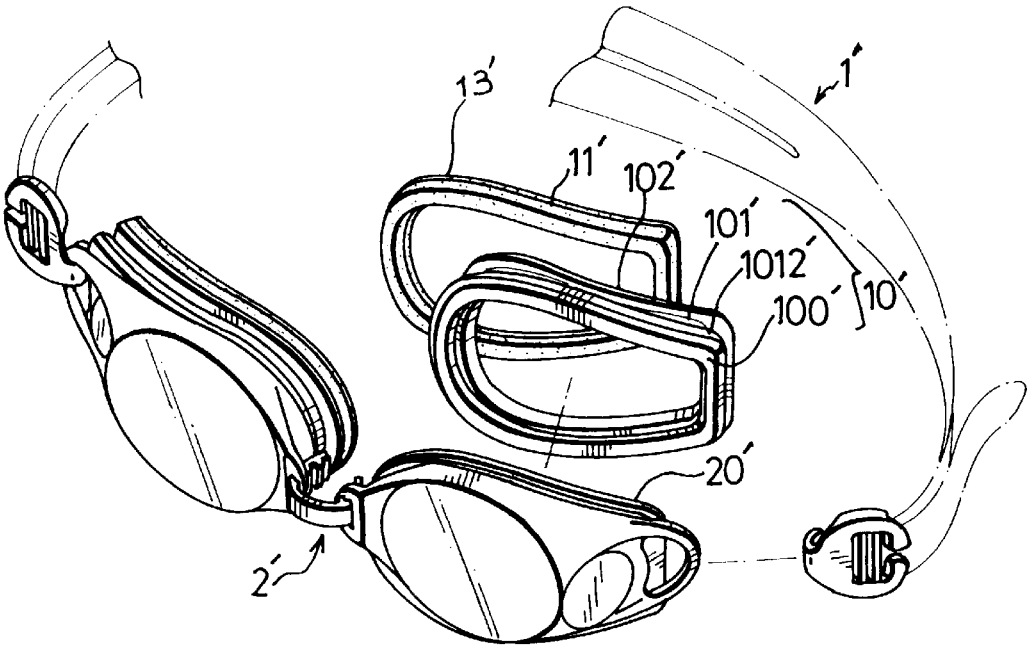
FIG. 7 is a partially exploded perspective view showing a second embodiment of the present invention wherein the cushion pad in accordance with the present invention detachably fit to lens frames of the swimming goggles.

With reference to FIG. 7, which shows a second embodiment in accordance with the present invention, the cushion pads 1' of the second embodiment of the present invention, rather than integrally formed with the lens frames, are separate from the lens frames 2' and releasably fit onto the frame 2'. As shown, the cushion pads 1' of the second embodiment are substantially identical to those of the first embodiment, except that the second embodiment is made separate from the lens frame 2', similarly comprising a collapsible layer 10' and a resilient layer 11'. The collapsible layer 10' comprises a cushioning portion and a connection portion. The cushioning portion comprises a circumferential fitting groove 100' and a J-sectioned segment 101', having an overall length ranging 2–5 mm and preferably 3.5 mm. The circumferential fitting groove 100' is fit onto a corresponding circumferential raised rib 20' on the respective lens frame 2' to allow the J-sectioned segment 101' to extend therefrom in a diverging manner to define a bent section 1012' from which the connection portion 102' extends for defining a flange to which the resilient layer 11' is fixed by means of for example adhesive. The resilient layer 11' may be made of for example foam material, such as foam rubber, having a face contact surface to which a piece of cloth material 13' is attached to provide a comfortable engagement with the face skin of the wearer around the eye socket. The overall thickness of the resilient layer 11', together with the cloth material 13' may range between 2–5 mm and is preferably 2.5 mm.

Figure 8:
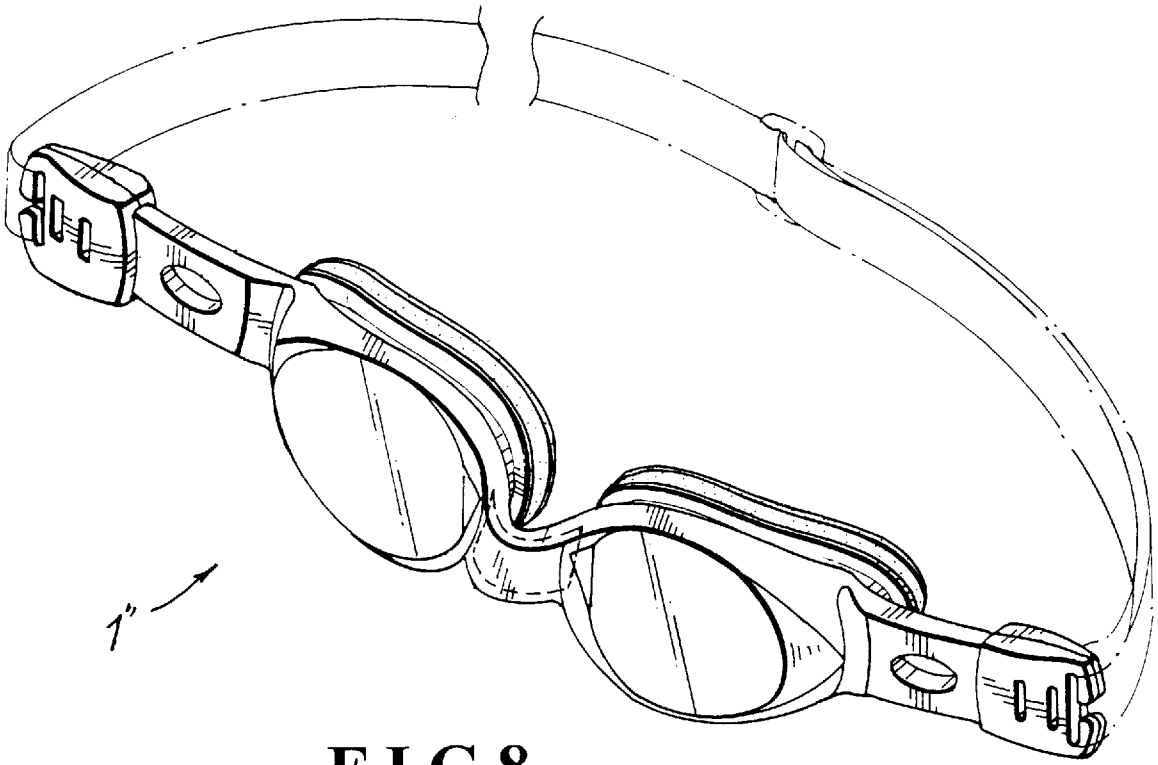
FIG. 8 is a perspective view showing a pair of swimming goggles to which cushion pads in accordance with the present invention are mounted, the frame the nose bridge and the cushion pads being connected to each other.

Although it is shown in FIGS. 4–7 that the cushion pad in accordance with the present invention is incorporated in swimming goggles having two separate lens frames connected by a separate nose bridge, it is quite clear that the present invention may also be adapted in swimming goggles wherein the two lens frames are integrally formed as a single piece by means of a nose bridge extending therebetween and integrally therewith, as shown in FIG. 8 in which a pair of swimming goggles in accordance with a third embodiment of the present invention, generally designated at 1 is shown. Such a pair of swimming goggles 1' adapt the same technique as discussed above to provide the present inventive cushion pad for more securely and for a hermetically attaching to the wearer'face skin and more comfortable engagement with the face skin.

Moreover, the two collapsible layers that as disclosed herein are made separate from each other but it is quite clearly that they may be formed as a single, unitary member.

Similarly, the two resilient layers in the embodiments illustrated are separate, but may be integrally formed as a single member.

The above description is made with respect to the preferred embodiments of the present invention and for those skilled in the art, it is possible to make a variety of modifications and changes to the above-described specific embodiments without departing from the scope and spirit of the present invention. All these modifications and changes should be considered within the scope of the present invention as defined in the appended claims.

What is claimed is:

1. A cushion pad structure for swimming goggles, wherein the swimming goggles comprise lens frames holding therein lenses, a nose bridge connecting inner sides of the lens frames and a head strap connecting outer sides of the lens frames, each of the lens frames having the cushion pad structure mounted thereto, said cushion pad structure comprising:

a collapsible layer and a resilient layer, the collapsible layer is mounted on the lens frame and is collapsible when the goggles are worn on a face of a wearer so as to create a negative pressure between the goggles and the wearer's face ,and the resilient layer is attached to the collapsible layer to provide a comfortable engagement with the wearer's face the collapsible layer comprise a cushioning portion and a connection portion, the cushioning portion being connected to the lens frames and frame and collapsible, the connection portion providing a flange to which the resilient layer is attached, the resilient layer is made of a resilient material selected from a group including foam material and sponge, the resilient layer further comprises a piece of cloth material attached thereto to render an overall thickness between 2 and 5 mm; and wherein the cushioning portion of the collapsible layer has a J-shaped cross section, comprising a straight section having an inner end fixed to and extending from the lens frame and an outer end to which a bent section is fixed, the bent section extending from the straight section in a diverging manner to define an outermost surface, a length from the inner end of the straight section to an intersection between the outermost surface and a line extended from the straight section being between 2–5 mm, the straight section having a thickness of 0.7–2 mm, the connection portion extending from the bent section on the outermost surface and having a thickness of 0.7–2 mm.

2. The cushion pad structure as claimed in claim 1, wherein the resilient layer is attached to the collapsible layer by means of adhesive.

3. The cushion pad structure as claimed in claim 2, wherein the inner end of the straight section of the cushioning portion comprises a circumferential fitting groove to fit onto the lens frame for mounting the collapsible layer to the lens frame.

4. The cushion pad structure as claimed in claim 2, wherein the inner end of the straight section of the cushioning portion is integrally formed with the lens frame.

5. A swimming goggles structure comprising:

a pair of lens frames, each having a cushion pad integrally formed therewith, a connecting piece connecting the lens frames, each of the lens frames comprising a receiving slot, a pair of lenses, each being received by one of the receiving slots, and a head strap connecting outer sides of the lens frames, wherein the cushion pad comprises a collapsible layer integrally formed with the lens frame and a resilient layer attached to the collapsible layer, wherein the collapsible layer collapses when the swimming goggles are worn on the face of a wearer so as to create a negative pressure between the swimming goggles and the face, and wherein the resilient layer provides a comfortable engagement with the wearer's face, and wherein the collapsible layer comprises a cushioning portion and a connection portion, the cushioning portion having a J-shaped cross section comprising a straight section and a bent section, the straight section having an inner and an outer end from which the bent section extends in a diverging manner to define an outermost surface, the cushioning portion having an overall length from the inner end to the outermost surface between 2–5 mm, the straight section of the cushioning portion having a thickness between 0.7–2 mm, the connection portion extending from the bent section on the outermost surface to provide a surface to which the resilient layer is attached and having a thickness between 0.7–2 mm.

6. The swimming goggles structure as claimed in claim 5, wherein the resilient layer is made of a resilient material selected from a group consisting of foam material and sponge and further comprises a piece of cloth material attached thereto to render an overall thickness between 2–5 mm.

7. A swimming goggles structure comprising:

a pair of lens frames, each having a cushion pad integrally formed therewith, a connecting piece integrally formed with and connecting the lens frames, each of the lens frames comprising a receiving slot.

a pair of lenses, each being received by one of the receiving slots, and a head strap connecting outer sides of the lens frames; wherein the cushion pad comprises a collapsible layer integrally formed with the lens frame and a resilient layer attached to the collapsible layer, wherein the collapsible layer collapses when the swimming goggles are worn on the face of a wearer so as to create a negative pressure between the swimming goggles and the face, and wherein the resilient layer provides a comfortable engagement with the wearer's face, and wherein the collapsible layer comprises a cushioning portion and a connection portion, the cushioning portion having a J-shaped cross section comprising a straight section and a bent section, the straight section having an inner and an outer end from which the bent section extends in a diverging manner to define an outermost surface, the cushioning portion having an overall length from the inner end to the outermost surface between 2–5 mm, the straight section of the cushioning portion having a thickness between 0.7–2 mm, the connection portion extending from the bent section on the outermost surface to provide a surface to which the resilient layer is attached and having a thickness between 0.7–2 mm.

8. The swimming goggles structure as claimed in claim 7, wherein the resilient layer is made of a resilient material selected from a group consisting of foam material and sponge and further comprises a piece of cloth material attached thereto to render an overall thickness between 2–5 mm.

9. A swimming goggles structure comprising:

a pair of lens frames, each having a cushion pad mounted thereto, the cushion pad comprising an extended section, each of the lens frames comprising a receiving slot, a pair of lenses, each being received by one of the receiving slots, and a head strap connecting the extended sections of the cushion pad; wherein the cushion pad comprises a collapsible layer integrally formed with the lens frame and a resilient layer attached to the collapsible layer, wherein the collapsible layer collapses when the swimming goggles are worn on the face of a wearer so as to create a negative pressure between the swimming goggles and the face, and wherein the resilient layer provides a comfortable engagement with the wearer's face, and wherein the collapsible layer comprises a cushioning portion and a connection portion, the cushioning portion having a fitting groove formed on one end thereof and a J shape formed on a second end with an overall length between 2–5 mm, the J shape comprising a straight section and a bent section, the straight section having an inner on which the fitting groove is formed to connect to the lens frame and an outer end from which the bent section extends in a diverging manner to define an outermost surface, the straight section of the cushioning portion having a thickness between 0.7–2 mm, the connection portion extending from the bent section of the J shape on the outermost surface to provide a surface to which the resilient layer is attached and having a thickness between 0.7–2 mm.

10. The swimming goggles structure as claimed in claim 9, wherein he resilient layer is made of a resilient material selected from a group consisting of foam material and sponge and further comprises a piece of cloth material attached thereto to render an overall thickness between 2–5 mm.

11. A swimming goggles structure comprising:

a pair of lens frames, each having a cushion pad integrally formed therewith, a nose integrally formed with and connected to inner sides of the lens frames, each of the lens frames comprising a receiving slot and an extended section, a pair of lenses, each being received by one of the receiving slots, a head strap connecting the extended sections of the lens frames; wherein the cushion pad comprises a collapsible layer fit onto the lens frame and a resilient layer attached to the collapsible layer, wherein the collapsible layer collapses when the swimming goggles are worn on the face of a wearer so as to create a negative pressure between the swimming goggles and the face, and wherein the resilient layer provides a comfortable engagement with the wearer's face, and wherein the collapsible layer comprises a cushioning portion and a connection portion, the cushioning portion having a J-shaped cross section comprising a straight section and a bent section, the straight section having an inner integrally formed with the lens frame and an outer end from which the bent section extends in a diverging manner to define an outermost surface, the cushioning portion having an overall length from the inner end to the outermost surface between 2–5 mm, the straight section of the cushioning portion having a thickness between 0.7–2 mm, the connection portion extending from the bent section on the outermost surface to provide a surface to which the resilient layer is attached and having a thickness between 0.7–2 mm.

12. The swimming goggles structure as claimed in claim 11, wherein the resilient layer is made of a resilient material selected from a group consisting of foam material and sponge and further comprises a piece of cloth material attached thereto to render an overall thickness between 2–5 mm.

* * * * *